US006830355B2

(12) United States Patent
Bass et al.

(10) Patent No.: US 6,830,355 B2
(45) Date of Patent: Dec. 14, 2004

(54) REFRACTIVE SHEET LIGHTING ASSEMBLY FOR AN ELEVATOR

(75) Inventors: Patrick M. Bass, Lakeside, CA (US); John W. Koshak, Ramona, CA (US); Aranggi Soemardjan, El Cajon, CA (US)

(73) Assignee: Thyssen Elevator Capital Corp., El Cajon, CA (US)

( * ) Notice: Subject to any disclaimer, the term of this patent is extended or adjusted under 35 U.S.C. 154(b) by 0 days.

(21) Appl. No.: 10/339,440

(22) Filed: Jan. 9, 2003

(65) Prior Publication Data

US 2004/0136199 A1 Jul. 15, 2004

(51) Int. Cl.[7] ..... F21V 8/00
(52) U.S. Cl. ..... 362/31; 362/147
(58) Field of Search ..... 362/148, 26, 31, 362/147, 330, 362, 479, 488, 490, 493, 511, 576

(56) References Cited

U.S. PATENT DOCUMENTS

| | | | | |
|---|---|---|---|---|
| 3,752,974 A | * | 8/1973 | Baker et al. | 362/31 |
| 4,126,210 A | | 11/1978 | Martin | 187/1 R |
| 4,223,374 A | * | 9/1980 | Kimmel | 362/31 |
| 4,704,662 A | | 11/1987 | Makino | 362/147 |
| 4,709,308 A | | 11/1987 | Makino | 362/148 |
| 4,765,076 A | * | 8/1988 | Sada | 362/812 |
| 5,862,889 A | | 1/1999 | Sevilleja et al. | 187/414 |

FOREIGN PATENT DOCUMENTS

| | | |
|---|---|---|
| JP | 01-308385 | 12/1989 |
| JP | 01-313294 | 12/1989 |
| JP | 03-042482 | 2/1991 |
| JP | 04-020491 | 1/1992 |
| JP | 04-032485 | 2/1992 |
| JP | 04-106088 | 4/1992 |
| JP | 05-193878 | 8/1993 |
| JP | 07-111103 | 4/1995 |
| JP | 09-100081 | 4/1997 |
| JP | 2000-191257 | 7/2000 |

OTHER PUBLICATIONS

International Search Report issued for International Appln. PCT/US2004/000350.
Written Opinion issued for International Appln. PCT/US2004/000350.

* cited by examiner

*Primary Examiner*—Y My Quach Lee
(74) *Attorney, Agent, or Firm*—Frost Brown Todd LLC

(57) ABSTRACT

An elevator cab lighting assembly comprising a refractive sheet mounted on the interior of the elevator cab. A light source is mounted at and conducts light into an outer edge of the refractive sheet. The light received at the outer edge of the travels along the refractive sheet and passes out of the planar surface and inner edge of the sheet exposed within the interior of the cab. The refractive sheet may be randomly sanded or sandblasted to provide diffuse light. The sheet may be etched or routed in standard or custom designs to provide accent highlighting. The lighting assembly is housed within a transom assembly that may be accessed from the exterior of the cab.

40 Claims, 8 Drawing Sheets

REFRACTIVE SHEET LIGHTING ASSEMBLY FOR AN ELEVATOR

FIELD OF THE INVENTION

The present invention relates generally to the field of elevators, and, more particularly, to the field of lighting for elevator cabs.

BACKGROUND

Lighting assemblies conventionally available for elevator cabs use overhead or ceiling-mounted lighting fixtures. There are several disadvantages associated with conventional lighting assemblies.

Conventional lighting assemblies typically require 4 to 10 inches of extra cab height to accommodate the light fixtures and the diffuser devices used to scatter the light evenly throughout the cab. The assemblies require additional structural components in the ceiling of the cab to carry the weight of the assemblies. The additional structural components add to the overall size and weight of elevator car, which can be very undesirable, especially in modernizing existing elevators. The administrative codes governing elevator modernization often place very tight restrictions on the weight of replacement elevator parts (including the cab) used in the modernization.

Conventional lighting assemblies are easily accessible to the passengers within the cab and exposed to vandalism or inadvertent damage. If broken, shards of glass or other components of the fixture may fall into the interior of the elevator cab and injure passengers. Replacing and repairing broken components on conventional lighting assemblies is often expensive and time-consuming.

SUMMARY OF THE INVENTION

The invention overcomes the problems associated with conventional lighting assemblies for elevators by providing a novel elevator cab lighting assembly that uses a refractive sheet to provide a diffuse, glare-free light within the interior of the elevator cab. The invention also comprises elevator cabs containing such lighting assemblies.

The lighting assembly of the invention comprises a refractive sheet having opposed planar surfaces, an inner edge, and an outer edge. The sheet is mounted on the cab and has a portion exposed to the interior of the elevator cab. A light source is mounted at and conducts light into the outer edge of the sheet. Light transmitted from the outer edge refracts randomly and internally along the longitude of the sheet and passes through the portion exposed to the interior of the elevator cab.

The refractive sheet can be formed from any suitable material which would provide a diffuse, glare-free light within the interior of the elevator cab. In one embodiment, the refractive sheet comprises acrylic. However, any clear or translucent material may be used. For example, the sheet may also comprise other plastics or glass. Although a preferred thickness for the refractive sheet is about 0.250 inches, the sheet can vary in thickness or material provided its structural integrity is maintained when the elevator is in operation, and it emits the desired amount of light into the cab. The portion of the sheet exposed to the interior of the cab may include the inner edge of the sheet or may also include an area along one of the planar surfaces. The sheet may be a variety of shapes, such as a rectangle, a semi-circle, a spline, or any other linear or curved shape.

One of the planar surfaces may be randomly sanded or sandblasted. One of the planar surfaces may also be etched or routed. The etching or routing may be in standard or custom designs to provide accent highlighting. The sheet may also include a mirrored layer (or a polished metal foil) or a painted layer on one of the planar surfaces. The inner edge may also contain a mirrored layer to reflect light back into the portion bounded by planar surfaces and thus enhance the intensity of light passing through the portion exposed to the interior of the elevator cab.

The sheet typically will be mounted on a ceiling surface of the cab, but it may also be mounted on other surfaces within the cab, such as a wall or floor surface.

In a preferred embodiment, the lighting assembly also includes a transom assembly for housing the outer edge and the light source. The transom assembly also contains a guide for enhancing conduction of light into the outer edge. The transom assembly may be mounted on the interior or exterior of the cab. When mounted on the exterior of the cab, the transom assembly actually defines the upper front comer section of the cab and intrudes into the space or ceiling height of the cab.

The transom assembly preferably includes a perforated face plate for being exposed to the interior of the cab and for diffusing light from the light source into the cab. The perforations of the face plate can be in the form of holes, gratings, grill bars, a plurality of slots or other light transmitting features. The face plate is of a sturdy configuration and is resistant to tampering and other forms of damage. In this case, the transom includes a lens mounted between the light source and the face plate. In addition, the inner edge is preferably aligned with the face plate and is disposed just above the top of the face plate.

The invention provides effective illumination of an elevator cab from a space saving lighting assembly. The invention is designed so as to meet the elevator code for adequate cab illumination. The code requires at least 5 foot candles power intensity at the threshold of the elevator with the doors closed.

DETAILED DESCRIPTION OF THE INVENTION

The following embodiments are described with reference taken to the attached figures, which are intended to illustrate the invention but not limit the scope to these embodiments.

Figure 1:
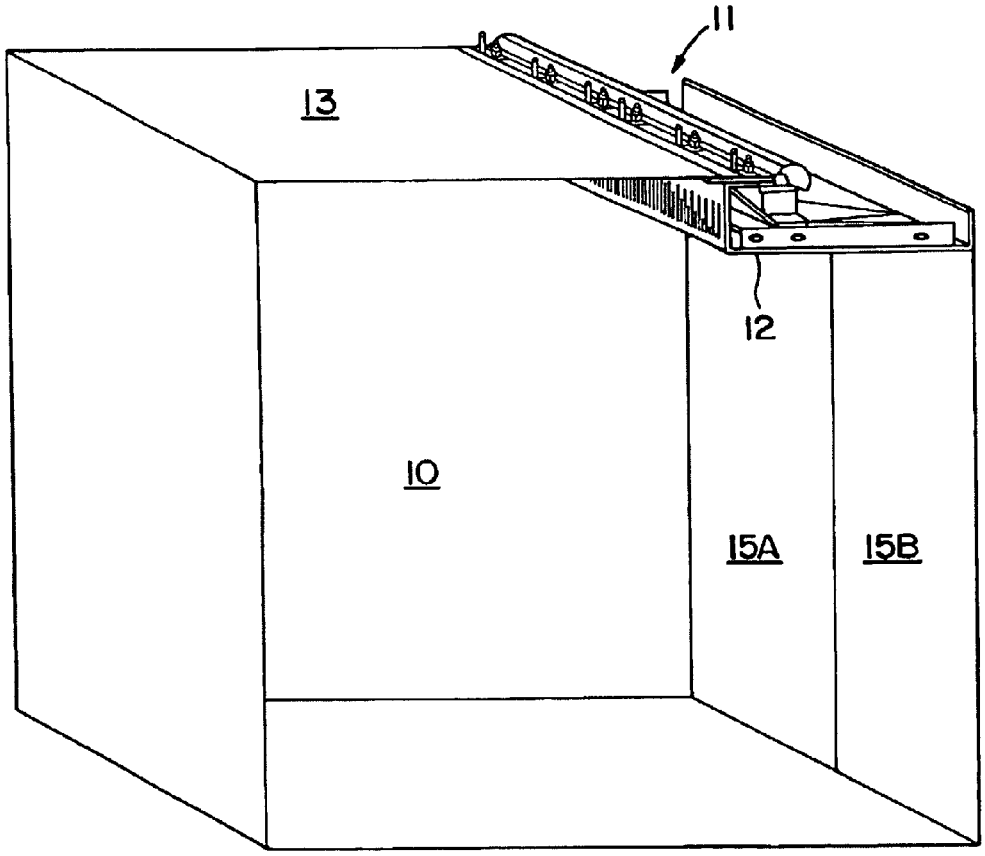
FIG. 1 is an isometric view of an elevator cab with an externally accessible transom containing the light assembly of the invention.
Figure 1A:
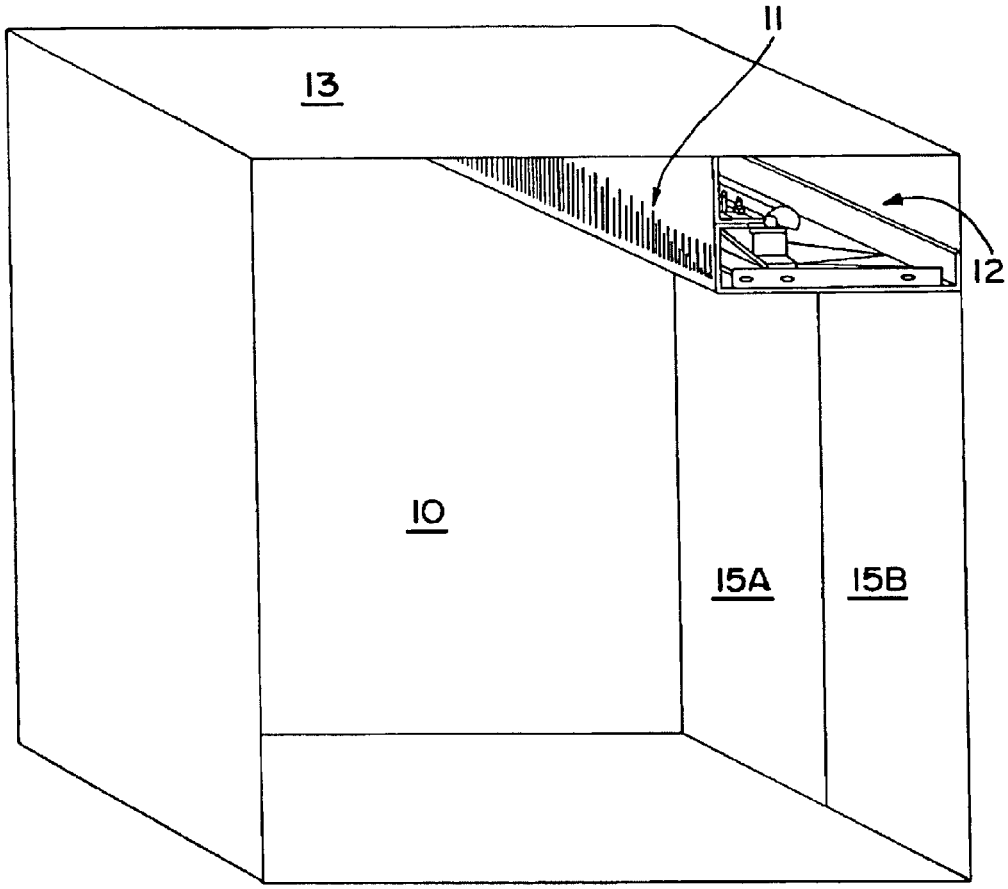
FIG. 1A is an isometric view of an elevator cab comprising a transom assembly mounted on the interior of the cab.

FIG. 1 generally shows an elevator cab 10 having doors 15A and 15B and containing the lighting assembly 11 of the invention located in a transom 12 that is mounted on the exterior of the cab 10 so that the lighting assembly 11 is accessible from the exterior of the cab 10. FIG. 1A is an isometric view of an elevator cab comprising a transom assembly mounted on the interior of the cab.

Figure 2:
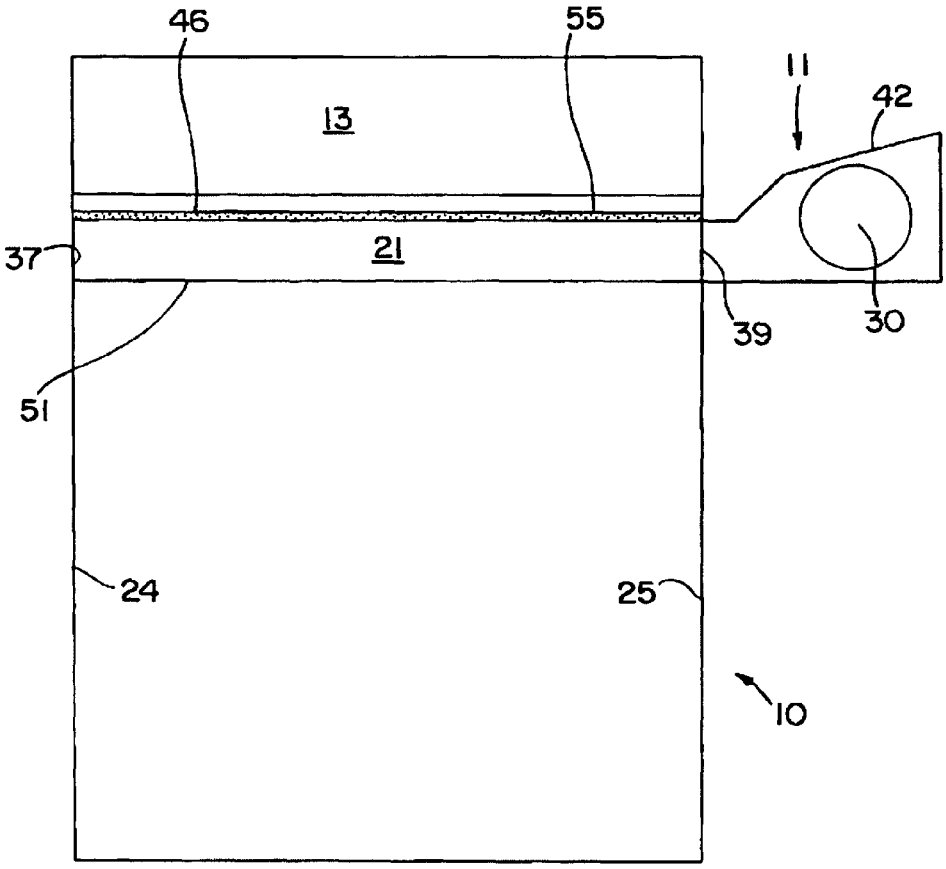
FIG. 2 is a side view of the elevator cab portion displaying a cross-section of the lighting assembly concept of the invention.
Figure 2A:
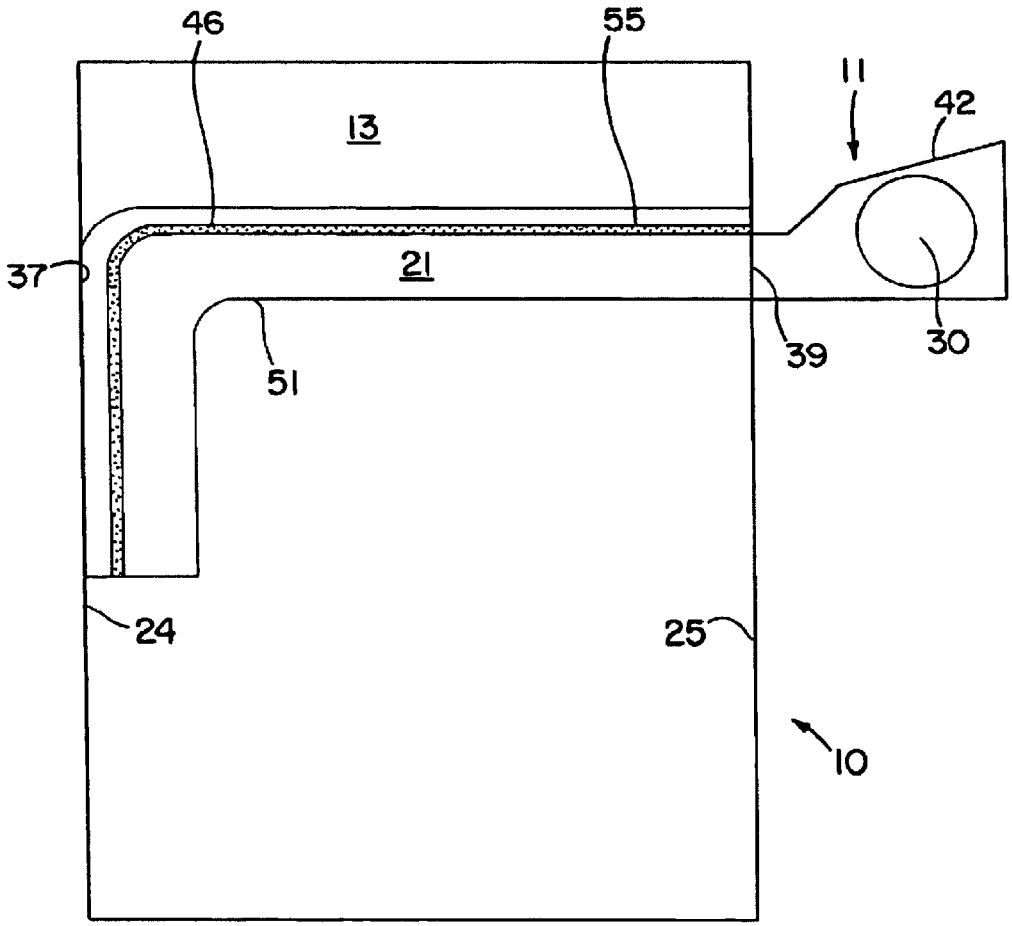
FIG. 2A is a side view of an elevator cab portion displaying a cross-section of another embodiment of the invention, wherein a refractive sheet is adapted for being mounted on a wall surface of the cab.

FIG. 2 show is a cross-sectional view of the general concept of the invention. The lighting assembly 11 includes a light refractive sheet 21 that extends along and adjacent to the ceiling 13 of the cab 10 between cab walls 24 and 25 to an inner edge 37, which may be mirrored. FIG. 2A shows a cross-section of another embodiment of the invention, wherein the sheet 21 is adapted for being mounted on a wall surface 24 of the cab 10.

The refractive sheet 21 has an inner edge 37 (which may be mirrored), upper and lower planar surfaces 46 and 51, respectively, and an outer edge 39. The outer edge 39 is adjacent to a light source 30 and attached or adjacent to a reflective guide 42. The reflective guide 42 directs the light coming from light source 30 into the outer edge 39. The light is then transmitted into the body of the sheet 21, where it is scattered randomly throughout. The upper planar surface 46 may be randomly sandblasted (indicated by dots 55). Light in the body of the sheet then passes out of the lower planar surface 51 into the cab 10.

The reflective guide 42 has appropriate internal mirroring finish or coating to reflect and direct the light into the outer edge 39 of the sheet 21.

Figure 3A:
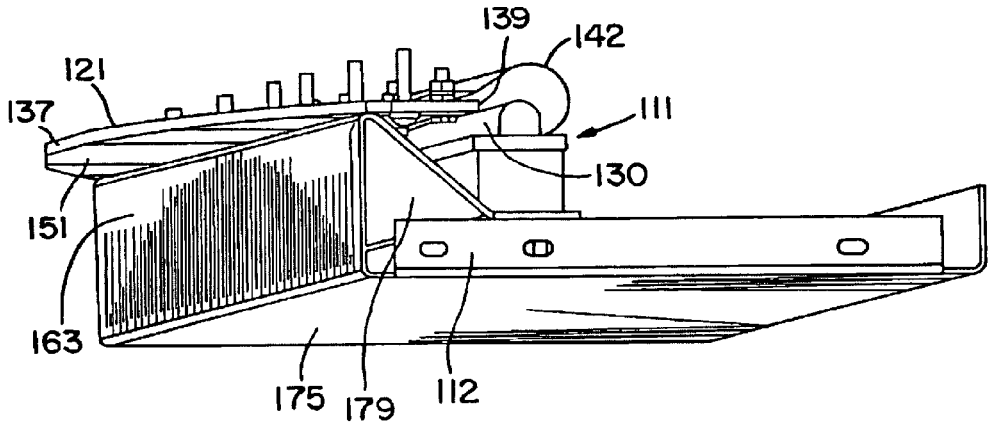
FIG. 3A is an oblique view of a lighting assembly according to the invention having a semi-circular refractive sheet extending from the transom assembly.
Figure 3B:
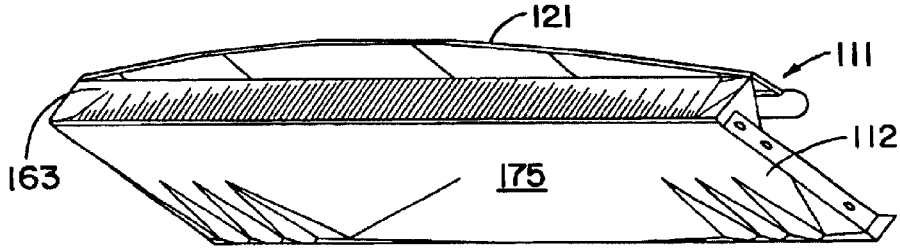
FIG. 3B is an underside oblique view of the lighting assembly shown in FIG. 3A.
Figure 3C:
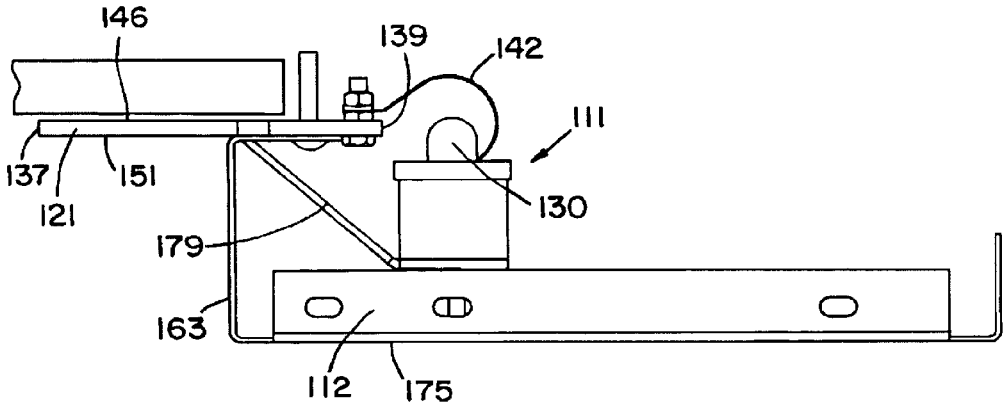
FIG. 3C is a side view of the lighting assembly shown in FIG. 3A.

FIGS. 3A, 3B and 3C show different views of a particular embodiment of the lighting assembly of the invention wherein the refractive sheet 121 extending from the transom 112 has a semi-circular shape. The lighting assembly 111 has a light source 130 and a reflective guide 142 that directs light from the light source 130 into an outer edge 139 of the refractive sheet 121.

The transom 112, which houses the lighting assembly 111 contains a perforated face plate 163 that extends vertically from the refractive sheet 121 to the bottom portion 175 of the transom 112. Light from light source 130 that is not conducted into the outer edge 139 of the sheet 121 is directed through a lens 179 and through the perforated face plate 163 into the cab. The transom tray 112 supporting the light assembly 111 may be dimensioned to any suitable width up to the width of the elevator cab itself so as to fit the transom of the elevator cab.

FIGS. 3A and 3B show underside views of the transom 112. The tubular light source 130, for example a fluorescent light fixture, extends the full width of the assembly 111. Other lighting sources can include incandescent bulbs or for certain purposes may include emergency battery powered LED light emitters. The perforated face plate 163 does not have to be vertical but can be at another angle with regard to the bottom portion 175 of the tray 112.

Referring now to FIG. 3C, light from the light source 130 is transmitted out of the transom 112 in two ways. First, light from the source 130 is directed by reflective guide 142 into the outer edge 139 of the refractive sheet 121. The light travels laterally along the sheet into the portion exposed to the interior of the cab. The upper planar surface 146 is treated to prevent light from exiting that surface; for example the upper surface 146 may be randomly sand-blasted, mirrored, painted, etched, routed, or coated with a polished metal foil. Light therefore passes out of the lower planar surface 151 and the inner edge 137.

The lighting assembly 111 of this embodiment may be fixed in the front corner of an elevator cab, for example as shown in FIG. 1. In this manner, the transom 112 is accessible from the exterior of the cab, which will ease maintenance. For example, a worker located at an elevator landing may raise the cab so that the top of the cab is at the level of the landing, where the worker can easily change the light source 130 or other components of the assembly 111 from outside the cab. This eases maintenance and does not require the worker to go into the cab compartment.

Figure 4A:
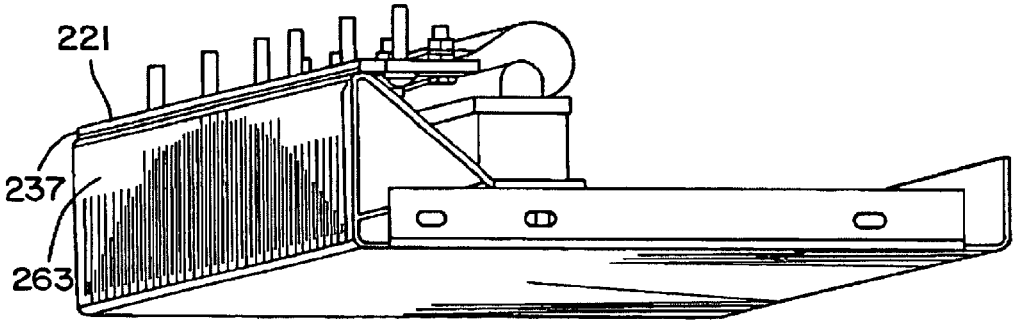
FIG. 4A is an oblique view of a lighting assembly according to the invention having a refractive sheet extending to an inner edge that is aligned with the face plate of the transom assembly.
Figure 4B:
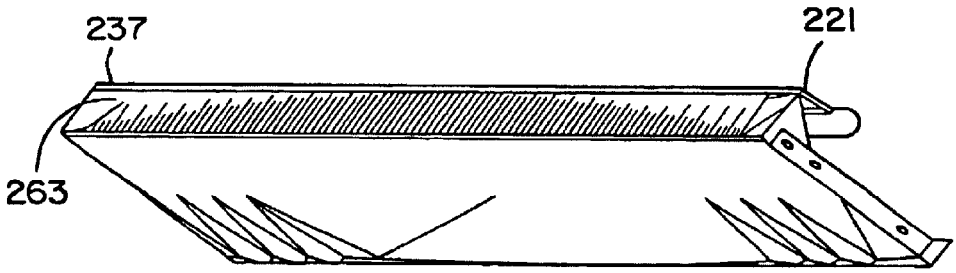
FIG. 4B is an underside oblique view of the lighting assembly shown in FIG. 4A.
Figure 4C:
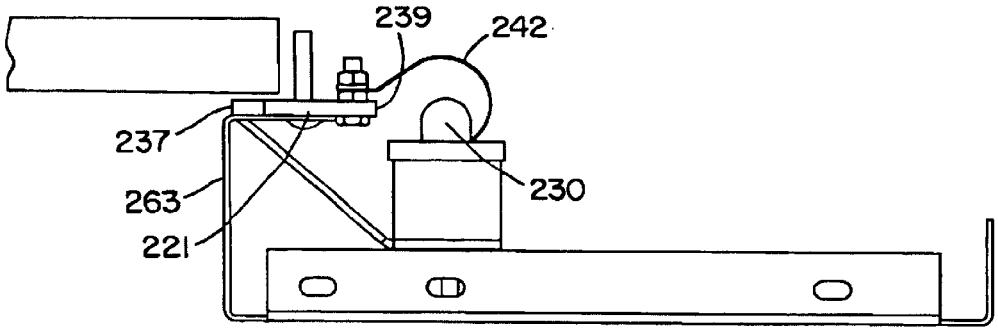
FIG. 4C is a side view of the lighting assembly shown in FIG. 4A.

FIGS. 4A, 4B, and 4C show an additional embodiment of the invention similar to that shown in FIGS. 3A–C, but having the inner edge 237 of the sheet 221 aligned and directly above the face plate 263. This arrangement avoids exposure of the sheet 221 to the interior of the cab so as to prevent damage. Referring to FIG. 4C, the arrangement functions similarly to the assembly shown in the FIGS. 3A–C, with one exception. In FIGS. 4A–C, light conducted from the light source 230 by reflective guide 242 into the outer edge 239 of the sheet 221 travels through the body of the sheet 221 exits at inner edge 237 where it then may be dispersed into the cab. As with the other shown embodiments the upper and lower planar surfaces of the refractive sheet may be treated (painted, mirrored, sand-blasted, or etched) to maximize the intensity of light transmitted from inner edge 237.

While the invention has been particularly shown and described with reference to particular embodiments, those skilled in the art will understand that various changes in form and details may be made without departing form the spirit and scope of the invention.

What is claimed is:

1. An elevator cab lighting assembly comprising:

a refractive sheet hiving opposed planar surfaces, an inner edge, and an outer edge, the sheet for being mounted on the cab and having a portion exposed to the interior of the elevator cab;

a light source mounted at and conducting light into the outer edge of the sheet; and a transom assembly for housing the outer edge and the light source, wherein light is transmitted from the outer edge through the portion exposed to the interior of the elevator cab.

2. The elevator cab lighting assembly of claim 1, wherein the sheet comprises acrylic.

3. The elevator cab lighting assembly system of claim 2, wherein the sheet is about 0.250 inches thick.

4. The elevator cab lighting assembly of claim 1, wherein the portion exposed to the interior of the cab comprises the inner edge.

5. The elevator cab lighting assembly of claim 4, wherein the portion exposed to the interior of the cab further comprises an area along one of the planar surfaces.

6. The elevator cab lighting assembly of claim 5, wherein one of the planar surfaces is randomly sanded or sand-blasted.

7. The elevator cab lighting assembly of claim 5, wherein one of the planar surfaces is etched or routed.

8. The elevator cab lighting assembly of claim 5, further comprising a mirrored layer on one of the planar surfaces.

9. The elevator cab lighting assembly of claim 5, further comprising a painted layer on on one of the planar surfaces.

10. The elevator cab lighting assembly of claim 5, further comprising a mirrored layer on the inner edge.

11. The elevator cab lighting assembly of claim 1, wherein the sheet is adapted for being mounted on a ceiling surface of the cab.

12. The elevator cab lighting assembly of claim 1, wherein the sheet is adapted for being mounted on a wall surface of the cab.

13. The elevator cab lighting assembly of claim 1, wherein the transom assembly further comprises a guide for enhancing conduction of light into the outer edge.

14. The elevator cab lighting assembly of claim 1, wherein the transom assembly is adapted for being mounted on the exterior of the cab.

15. The elevator cab lighting assembly of claim 1, wherein the transom assembly is adapted for being mounted on the interior of the cab.

16. The elevator cab lighting assembly of claim 1, wherein the transom assembly further comprises a perforated face plate for being exposed to the interior of the cab and for diffusing light from the light source into the cab.

17. The elevator cab lighting assembly of claim 16, wherein the transom assembly further comprises a lens mounted between the light source and the face plate.

18. The elevator cab lighting assembly of claim 17, wherein the inner edge is aligned with the face plate.

19. The elevator cab lighting assembly of claim 1, wherein the sheet is rectangular in shape.

20. The elevator cab lighting assembly of claim 1, wherein the sheet is semi-circular in shape.

21. An elevator cab and reflective sheet lighting assembly comprising:

an elevator cab having an interior and an exterior;

a refractive sheet having opposed planar surfaces, an inner edge, and an outer edge, the sheet for being mounted on the cab and having a portion exposed to the interior of the elevator cab;

light source mounted at and conducting light into the outer edge of the sheet; and a transom assembly for housing the outer edge and the light source, wherein light is transmitted from the outer edge through the portion exposed to the interior of the elevator cab.

22. The elevator cab of claim 21, wherein the sheet comprises acrylic.

23. The elevator cab of claim 22, wherein the sheet is about 0.250 inches thick.

24. The elevator cab of claim 21, wherein the portion exposed to the interior of the cab comprises the inner edge.

25. The elevator cab of claim 24, wherein the portion exposed to the interior of the cab further comprises an area along one of the planar surfaces.

26. The elevator cab of claim 25, wherein one of the planar surfaces is randomly sanded or sandblasted.

27. The elevator cab of claim 25, wherein one of the planar surfaces is etched or routed.

28. The elevator cab of claim 25, further comprising a mirrored layer on one of the planar surfaces.

29. The elevator cab of claim 25, further comprising a painted layer on one of the planar surfaces.

30. The elevator cab of claim 25, further comprising a mirrored layer on the inner edge.

31. The elevator cab of claim 21, wherein the sheet is adapted for being mounted on a ceiling surface of the cab.

32. The elevator cab of claim 21, wherein the sheet is adapted for being mounted on a wall surface of the cab.

33. The elevator cab of claim 21, wherein the transom assembly further comprises a guide for enhancing conduction of light into the outer edge.

34. The elevator cab of claim 21, wherein the ransom assembly is mounted on the exterior of the cab.

35. The elevator cab of claim 21, wherein the transom assembly is mounted on the interior of the cab.

36. The elevator cab of claim 21, wherein the transom assembly further comprises a perforated face plate for being exposed to the interior of the cab and for diffusing light from the light source into the cab.

37. The elevator cab of claim 36, wherein the transom assembly further comprises a lens mounted between the light source and the face plate.

38. The elevator cab of claim 37, wherein the inner edge is aligned with the face plate.

39. The elevator cab of claim 21, wherein the sheet is rectangular in shape.

40. The elevator cab of claim 21, wherein the sheet is semicircular in shape.

* * * * *

UNITED STATES PATENT AND TRADEMARK OFFICE

CERTIFICATE OF CORRECTION

PATENT NO. : 6,830,355 B2
DATED : December 14, 2004
INVENTOR(S) : Patrick M. Bass et al.

It is certified that error appears in the above-identified patent and that said Letters Patent is hereby corrected as shown below:

Column 4,
Line 42, "hiving" should read -- having --.

Column 5,
Line 42, "light source" should read -- a light source --.

Column 6,
Line 28, "ransom" should read -- transom --.

Signed and Sealed this

Third Day of May, 2005

JON W. DUDAS
*Director of the United States Patent and Trademark Office*